US009695632B2

(12) United States Patent
Anderson et al.

(10) Patent No.: US 9,695,632 B2
(45) Date of Patent: Jul. 4, 2017

(54) SPOOL HOUSING FOR A WINDOW COVERING

(71) Applicant: Hunter Douglas, Inc., Pearl River, NY (US)

(72) Inventors: Richard N. Anderson, Whitesville, KY (US); Robert E. Fisher, Thornton, CO (US)

(73) Assignee: Hunter Douglas Inc., Pearl River, NY (US)

( * ) Notice: Subject to any disclaimer, the term of this patent is extended or adjusted under 35 U.S.C. 154(b) by 0 days.

(21) Appl. No.: 14/715,859

(22) Filed: May 19, 2015

(65) Prior Publication Data

US 2015/0259977 A1 Sep. 17, 2015

Related U.S. Application Data

(63) Continuation-in-part of application No. 14/089,861, filed on Nov. 26, 2013, now Pat. No. 9,357,868.

(60) Provisional application No. 61/734,048, filed on Dec. 6, 2012, provisional application No. 61/873,055, filed on Sep. 3, 2013.

(51) Int. Cl.

| | |
|---|---|
| ***E06B 9/30*** | (2006.01) |
| ***E06B 9/322*** | (2006.01) |
| ***E06B 9/262*** | (2006.01) |
| *E06B 9/24* | (2006.01) |

(52) U.S. Cl.

CPC ..... *E06B 9/322* (2013.01); *E06B 9/262* (2013.01); *E06B 2009/2441* (2013.01); *E06B 2009/3222* (2013.01); *Y10T 16/372* (2015.01)

(58) Field of Classification Search

CPC ... E06B 9/262; E06B 9/322; E06B 2009/2441
USPC ..... 160/115
See application file for complete search history.

(56) References Cited

U.S. PATENT DOCUMENTS

| | | | | |
|---|---|---|---|---|
| 6,059,004 | A | 5/2000 | Oskam | |
| 6,223,802 | B1 * | 5/2001 | Colson | E06B 9/262 160/171 |
| 6,915,831 | B2 * | 7/2005 | Anderson | E06B 9/322 160/173 R |
| 7,264,033 | B2 * | 9/2007 | Lai | E06B 9/26 160/172 R |
| 7,896,056 | B2 * | 3/2011 | Ben-David | E06B 9/264 160/107 |
| 7,913,738 | B2 * | 3/2011 | Fraser | E06B 9/322 160/115 |
| 8,267,145 | B2 * | 9/2012 | Fraser | E06B 9/307 160/115 |
| 2004/0016514 | A1 * | 1/2004 | Nien | E06B 9/32 160/115 |
| 2005/0252618 | A1 * | 11/2005 | Hsu | E06B 9/262 160/84.03 |
| 2006/0048904 | A1 * | 3/2006 | Gruner | E06B 9/262 160/84.05 |
| 2006/0278348 | A1 | 12/2006 | Huang | |

(Continued)

FOREIGN PATENT DOCUMENTS

WO WO 2012/154871 11/2012

*Primary Examiner* — Katherine Mitchell
*Assistant Examiner* — Johnnie A Shablack
(74) *Attorney, Agent, or Firm* — Dority & Manning, P.A.

(57) ABSTRACT

A device for aid in feeding a cord through an opening wherein a U-shaped trough wall is provided at the inlet end of the opening to help collect and consolidate any loose ends of the cord.

22 Claims, 5 Drawing Sheets

(56) References Cited

U.S. PATENT DOCUMENTS

| | | | | |
|---|---|---|---|---|
| 2006/0289122 | A1* | 12/2006 | Lin | E06B 9/30 160/115 |
| 2009/0120593 | A1* | 5/2009 | Lesperance | E06B 9/322 160/84.02 |
| 2014/0158314 | A1* | 6/2014 | Anderson | E06B 9/322 160/368.1 |
| 2015/0144275 | A1* | 5/2015 | Ganzi | E06B 9/262 160/84.03 |
| 2015/0259977 | A1* | 9/2015 | Anderson | E06B 9/262 160/168.1 R |
| 2016/0010389 | A1* | 1/2016 | Anderson | E06B 9/322 188/65.1 |

* cited by examiner

SPOOL HOUSING FOR A WINDOW COVERING

BACKGROUND

This application is a continuation-in-part of U.S. application Ser. No. 14/089,861 filed Nov. 26, 2013, which claims priority from U.S. Application Ser. No. 61/873,055 filed Sep. 3, 2013, and from U.S. Application Ser. No. 61/734,048 filed Dec. 6, 2012, all of which are incorporated herein by reference.

The present invention relates to a spool housing for use in a window covering.

SUMMARY

In one embodiment of the present invention, a collection trough wall is provided at the inlet end of an opening in the spool housing to aid the user in gathering any frayed or loose ends of a cord and consolidating these ends into a cohesive end which can be readily "threaded" through the opening.

DESCRIPTION

Figure 1:
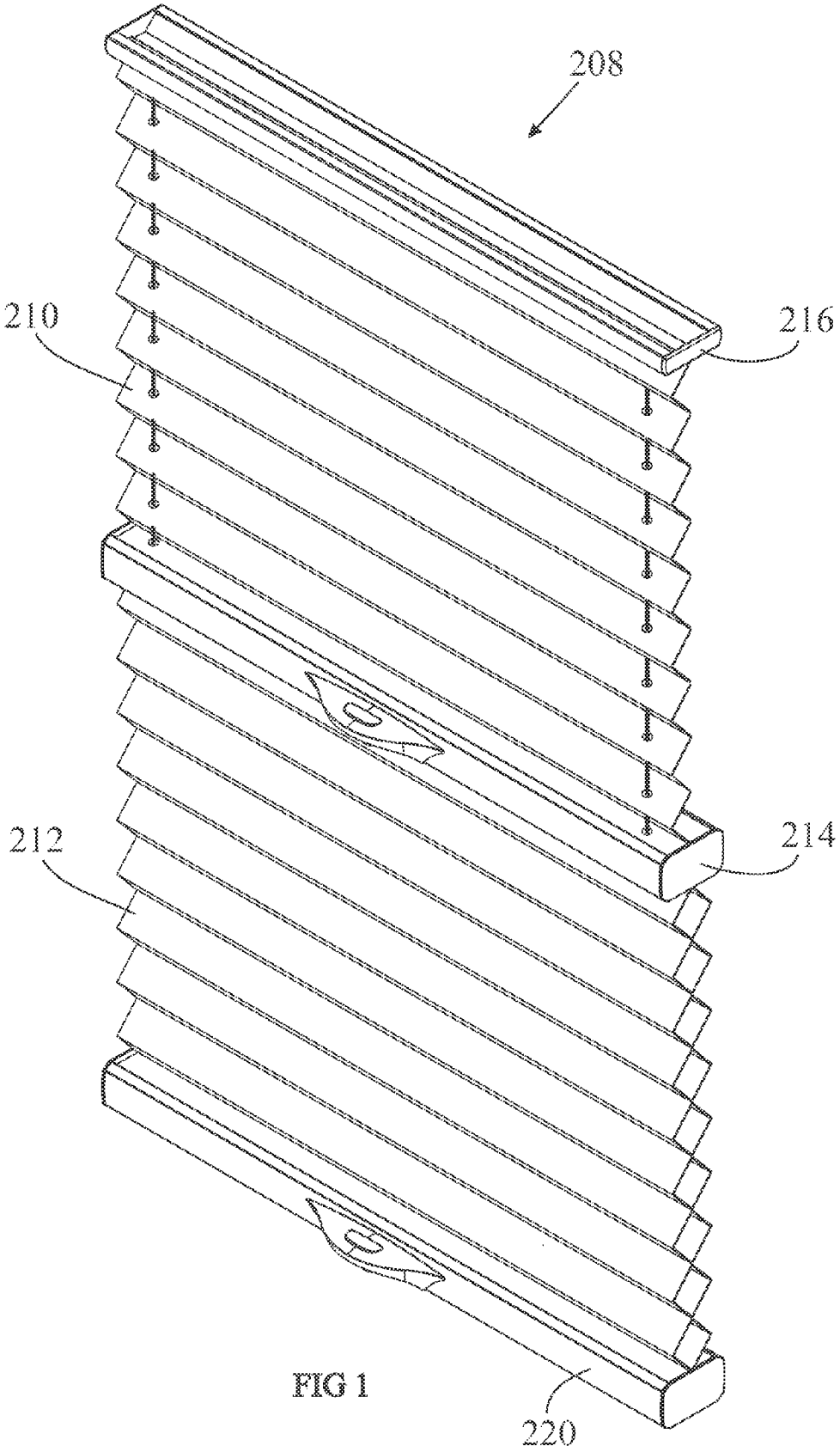
FIG. 1 is a perspective view of a window covering with a pleated shade and an intermediate movable rail above a cellular shade portion.

FIGS. 1-7 show a window covering 208, with lift stations 114' which allow two or more lift cords 200, 202 (See FIG. 2) to simultaneously travel through the same rout openings in the covering material 204 even though the lift cords 200, 202 each ultimately are connected to different lift stations. The lift cord 200 is connected to the lift station 114' shown in FIG. 2, and the lift cord 202 is connected to a lift station, not shown, housed in the bottom rail 220.

In the prior art, when there is an intermediate movable rail, each lift cord (the cord for the intermediate rail and the cord for the lower rail) has its own rout openings in the covering material, and the lift stations to which these different lift cords are attached are spaced apart horizontally so that the lift stations do not interfere with the lift cords. This is not an issue when the window covering is a cellular product (as shown in the bottom portion 212 of the shade of FIG. 1) as the cellular product hides the multiple lift cords extending vertically along the covering 212. However, if a portion of the window covering is open to expose the lift cords (such as the pleated shade portion 210 shown in the upper portion of FIG. 1), then running several lift cords which are spaced apart horizontally from each other results in an esthetically unappealing window covering.

Figure 2:
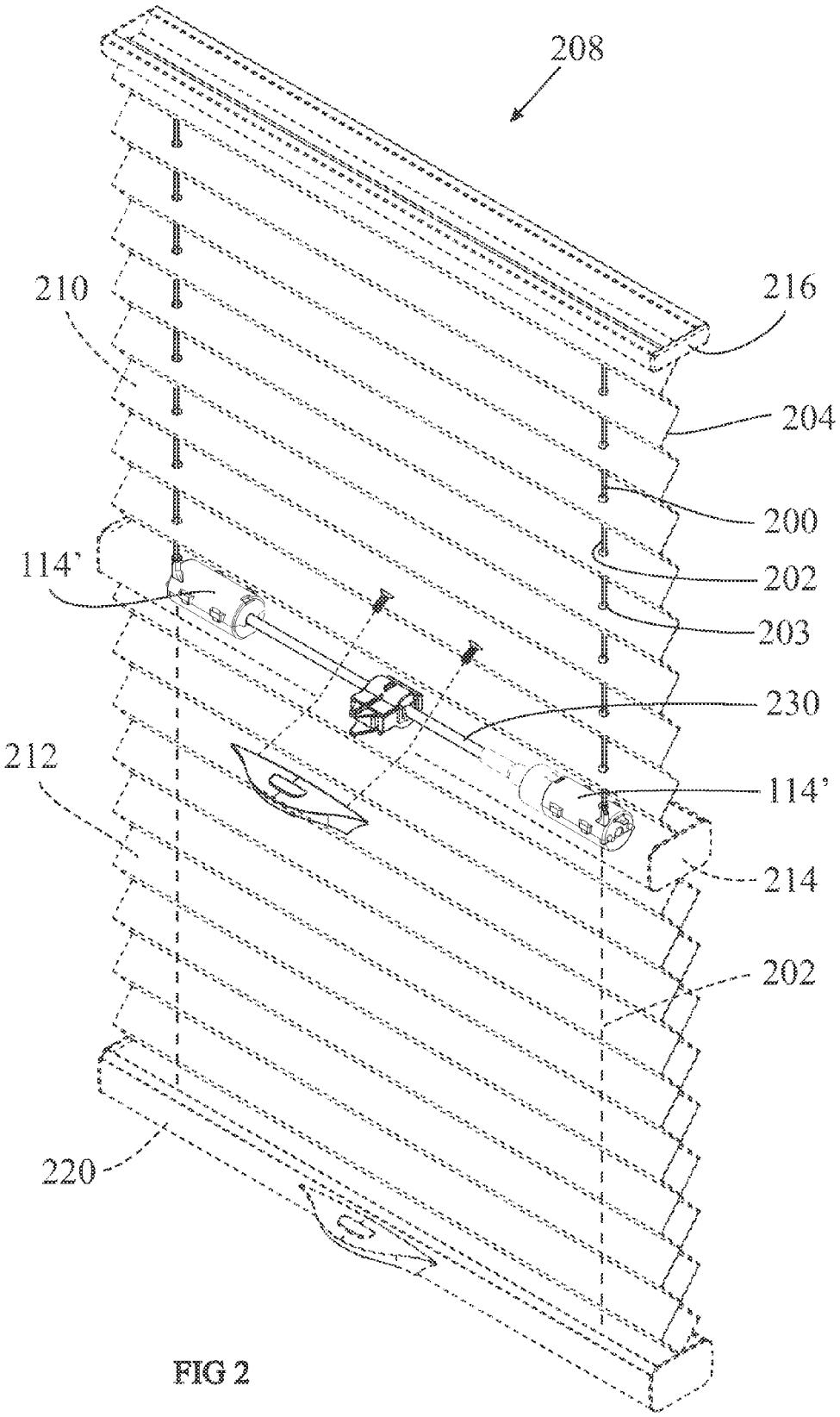
FIG. 2 is a perspective view of the window covering of FIG. 1 with the shades and rails shown in phantom, showing the cord drive of the intermediate rail with the rail handle exploded away.

The lift stations 114' in the intermediate rail 214 of FIG. 2 circumvent this problem by allowing two (or more) unrelated lift cords 200, 202 (See FIGS. 2, 3, and 6) to use the same set of vertically spaced-apart, aligned rout openings 203 on the covering material 204 (See FIG. 2), with a first lift cord 200 extending vertically from the head rail 216 and secured to the lift station 114' and a second, bypass lift cord 202 extending vertically from the head rail 216, going through the lift station 114' in the intermediate rail 214, and continuing vertically downwardly to a lift station (not shown) in the lower rail 220 without affecting the functionality of the lift station 114' and with no frictional penalty on the second "bypass" lift cord 202, as explained in more detail below.

It should be noted that feeding the ends of the lift cords 200, 202 into the inlet nozzle 206 on the lift station 114' would be a daunting task, as there are two relatively small and independent openings 232, 234 (See FIGS. 3, 6, and 7) in very close proximity to each other. However, the lift station 114' includes a U-shaped collection trough wall 240 (See FIG. 7) at the distal end of the inlet nozzle 206 that helps collect frayed ends on the lift cord and consolidates and lines up the end of the lift cord (200 or 202) with one of the openings (232, 234 respectively) to facilitate the feeding of the end of the lift cord, as explained in more detail later.

Referring now to FIGS. 1 and 2, the window covering 208 includes an upper pleated shade portion 210 and a lower cellular shade portion 212. The upper pleated shade portion 210 is suspended from the top rail 216 via a first set of lift cords 200; each of the lift cords 200 is secured to a spool 218 (shown in FIG. 6) which is mounted for rotation in one of the lift stations 114' located in the intermediate movable rail 214.

The lower cellular shade portion 212 is suspended from the top rail 216 via a second set of lift cords 202; each of the lift cords 202 being secured to a spool mounted for rotation in a lift station (not shown) located in the lower movable rail 220. It should be noted that the lift cords 202 are guided by and go through the lift stations 114' in the intermediate rail 214 without interacting with, or otherwise functionally affecting, the lift stations 114' and with no frictional penalty on the bypassed lift cords 202. The advantage, as best appreciated in FIG. 2, is that both sets of lift cords 200, 202 use the same set of aligned rout openings 203 through the upper pleated shade portion 210, as these two sets of lift cords 200, 202 travel in very close side-by-side relationship to each other, giving the impression of a single cord.

The housing of the lift station 114' is made up of a base 222 and a cover 224, which enclose the lift spool 218.

Figure 4:
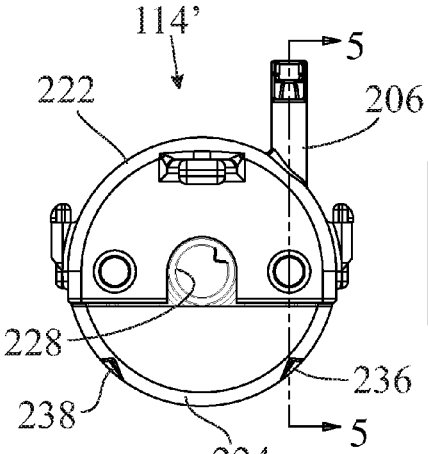
FIG. 4 is an end view of the bypass lift station of FIG. 3, with the lift cords removed for clarity.
Figure 5:
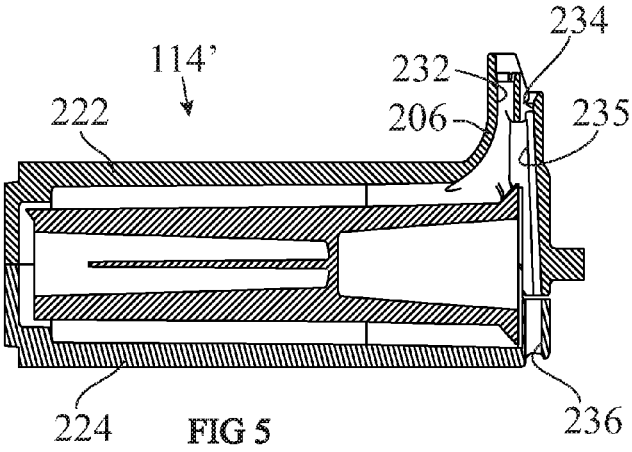
FIG. 5 is section view along line 5-5 of FIG. 4.
Figure 6:
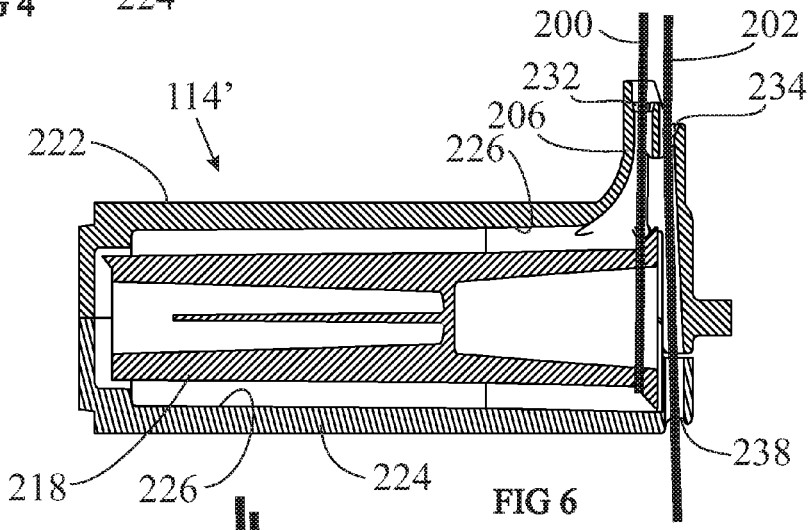
FIG. 6 is identical to FIG. 5, but showing the lift cords of FIG. 3.
Figure 3:
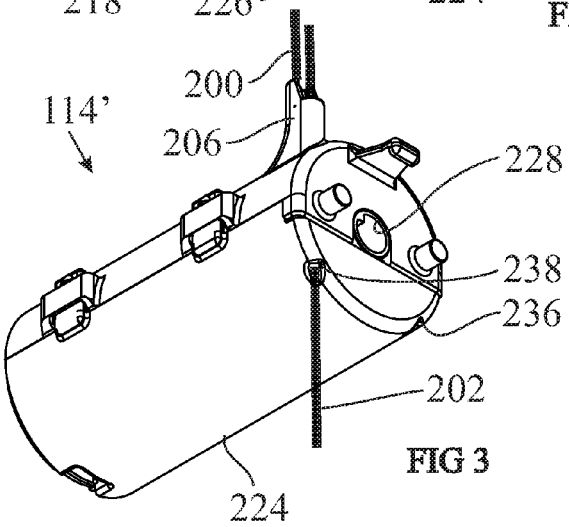
FIG. 3 is a perspective view of one of the bypass lift stations of FIG. 2.

As may be appreciated from FIGS. 3, 4, and 5, the wall of the base 222 of the lift station 114' includes an inlet nozzle 206 which defines first and second through openings 232, 234 (See FIG. 5). The first opening 232 receives the first lift cord 200 and guides it into the cavity 226, and the lift cord 200 is then secured to the spool 218 of the lift station 114'. The second opening 234 extends through an open channel 235 (See FIG. 5) in the end of the base 222, through the cavity 226, and out an opening 236 or 238 in the cover 224.

The cover 224 defines first and second through openings 236, 238 (See FIGS. 4 and 5) which lead from the cavity 226 to the outside of the lift station 114'. At least one of the openings 236, 238 lines up vertically with the corresponding opening 234 on the base 222, depending on the configuration of the lift station 114'. That is, the cover 224 is a universal cover to be used regardless of whether the lift station 114' is a right hand station (as shown in FIG. 4, wherein the inlet nozzle 206 is offset to the right of the hollow shaft 228 of the spool 218 and wherein the opening 236 on the cover 224 lines up with the opening 234 on the base 222) or a left hand station (as shown in FIG. 3, wherein the inlet nozzle 206 is offset to the left of the hollow shaft 228 of the spool 218 and wherein the opening 238 on the cover 224 lines up with the opening 234 on the base 222). In either case, the lift cord 202 extends straight through the lift station 114' without affecting the functionality of the lift station 114' and with no frictional penalty on the lift cord 202, as best appreciated in FIG. 6.

Figure 7:
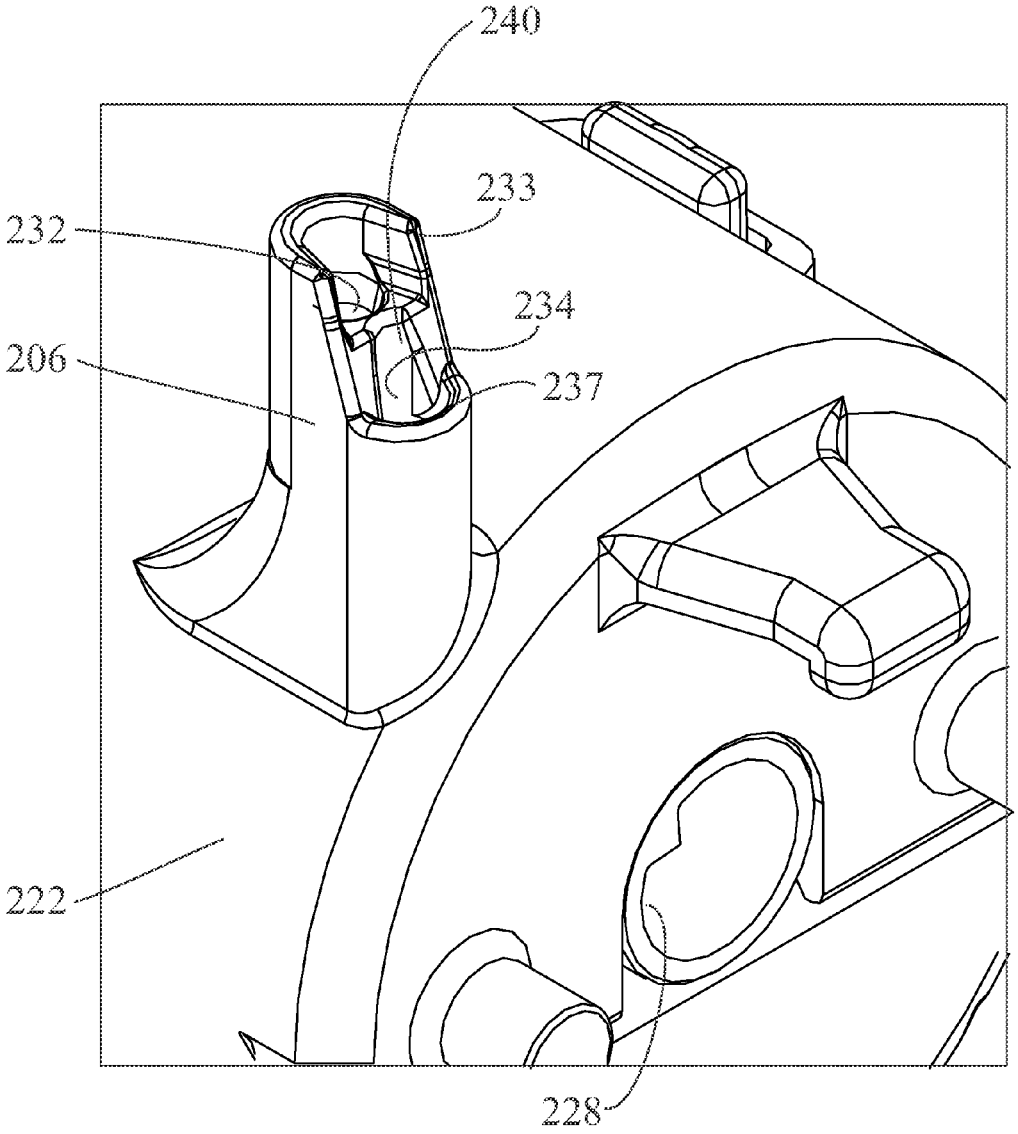
FIG. 7 is an enlarged perspective view of the inlet nozzle portion of the bypass lift station of FIG. 3.

Referring now to FIG. 7, the inlet nozzle 206 defines a "U"-shaped collection trough wall 240 which projects outwardly, away from the opening 234 and away from the cavity 226. The trough wall 240 projects outwardly, away from the opening 234 a distance that is greater than the diameter of the opening 234. The diameter of the opening 234 is slightly greater than the diameter of the cord 202. The opening 232 is located farther away from the axis of rotation of the spool 218 than the opening 234. The edges of the trough wall 240 are radiused inwardly to help collect and consolidate any loose ends of the lift cord, as described below.

To feed the lift cord 200 through the opening 232, the end of the lift cord 200 is pressed into the U-shaped trough wall 240. The act of pressing the end of the lift cord 200 into the trough wall 240 forces any loose ends/frayed ends to come together in the U-shaped trough 240. The lift cord 200 also may be rotated (or twirled) so all sides of the cord come into contact with the trough wall 240 in order to press together the frayed ends on all sides of the cord 200.

The top edge of the trough wall 240 lies adjacent to a first side of the second opening 232, and there is a second U-shaped trough wall 233 projecting outwardly away from, and surrounding, the remaining sides of the second opening 232. The second U-shaped trough wall 233 is adjacent to the opening 232 at other than the first side, where the first trough wall 240 ends. Once the end of the lift cord 200 has been pressed into the first trough wall 240, it is then a simple matter to raise the end of the cord 200 above the top edge of the first trough 240, over to the opening 232, and then downwardly into the opening 232.

The first trough 240 also lies adjacent one side of the opening 234, and there is a tapered wall 237 surrounding the other sides of the opening 234. (The tapered wall 237 is adjacent to the opening 234 at other than the side where the first trough wall 240 is located.) The end of the lift cord 202 is pressed into the trough 240 to consolidate any frayed ends and is then lowered into the opening 234.

The tapered walls 233, 237 are wider at their outer edge, farther away from the axis of rotation of the spool, and narrower approaching the respective opening 232, 234 (closer to the axis of the spool).

To assemble the lift station 114' the end of the first lift cord 200 is pressed against the upper portion of the first trough wall 240, as discussed above, and the end is then pushed into the opening 232 of the base 222 of the lift station 114'. Once the end of the lift cord 200 enters into the cavity 226 (before the cover 224 is assembled to the base 222) the lift cord 200 is secured to the spool 218. Next, the second lift cord 202 is pressed against the first trough wall 240 and is then threaded through the second opening 234 of the inlet nozzle 206, with the aid of the trough wall 240, as discussed above. Once the second lift cord 202 enters into the cavity 226, it is threaded through the outlet opening (236 or 238) in the cover 224 until the end of the cord 202 exits the cover 224. The spool 218 is then mounted for rotation inside the cavity 226, and the cover 224 is snapped onto the base 222. The assembled lift station 114' may now be installed onto a lift rod 230 inside the intermediate rail 214.

Of course, the second lift cord 202 then extends downwardly through the covering 212 (see FIG. 1) and is secured to its respective spool in the bottom rail 220.

Figure 8:
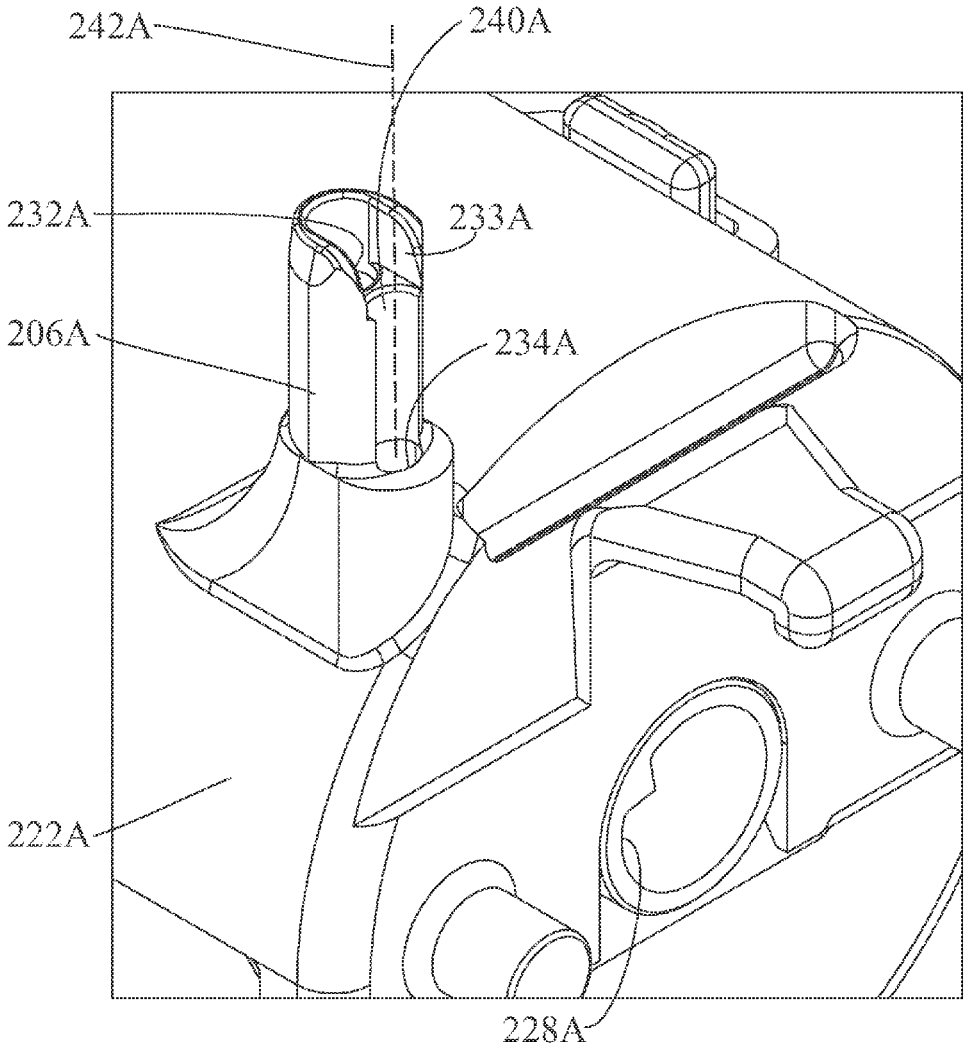
FIG. 8 is a view similar to FIG. 7 but for an alternative embodiment.

FIG. 8 shows an alternative embodiment, which includes a base 222A, a hollow shaft 228A, and an inlet nozzle 206A. The cover and spool are the same as in the previous embodiment. There are two openings 232A, 234A through the base 222A. There is a first U-shaped trough 240A, which has a vertical axis 242A (perpendicular to the axis of the spool), surrounding one side of the opening 234A, and there is a second U-shaped trough 233A, which also has a vertical axis (perpendicular to the axis of the spool), partially surrounding the opening 240A. In this embodiment, both the first and second U-shaped troughs 240A, 233A have a partial cylindrical shape.

While the trough arrangements described above are for a lift station, they also may be used for other spool housings on a window covering into which, or through which a cord passes, such as a housing for a tilt spool.

It will be obvious to those skilled in the art that modifications may be made to the embodiments described above without departing from the scope of the present invention as claimed.

What is claimed is:

1. A spool housing for a window covering, comprising a housing wall defining an interior and an exterior;

an inlet nozzle extending outwardly from said housing wall along its exterior, said inlet nozzle including a nozzle wall defining an opening for receiving a cord, at least a portion of said nozzle wall extending from a proximal end closest to said housing wall and terminating at a distal end further away from said housing wall; and a spool housed in the interior of said housing wall for winding up the cord and having an axis of rotation;

wherein:

said inlet nozzle includes a collection trough wall defining a portion of said opening;

said collection trough wall extends away from said distal end of said nozzle wall by a distance such that an outer edge of said collection trough wall is spaced farther apart from said axis of rotation than said distal end of said nozzle wall; and said collection trough wall defines an open face relative to said nozzle wall to permit said cord to be pushed against said collection trough wall from a direction perpendicular to an axis of said opening.

2. A spool housing for a window covering as recited in claim 1, wherein at least one edge of said collection trough wall is radiused inwardly.

3. A spool housing for a window covering as recited in claim 1, wherein:

said opening is a first opening and said cord is a first cord;

said inlet nozzle defines a second opening for receiving a second cord; and said second opening is positioned adjacent to said first opening.

4. A spool housing for a window covering as recited in claim 3, wherein said collection trough wall forms a common wall between said first opening and said second opening.

5. A spool housing for a window covering as recited in claim 3, wherein:

said axis of said first opening corresponds to a first axis and extends perpendicular to said axis of rotation; and said second opening defined a second axis extending parallel to said first axis.

6. A spool housing for a window covering as recited in claim 5, wherein said collection trough wall extends lengthwise along a trough axis which is parallel to said first and second axes.

7. A spool housing for a window covering as recited in claimy 3, wherein:

said collection trough wall is a first collection trough wall; and said inlet nozzle includes a second collection trough wall that extends away from said outer edge of said first collection trough wall such that a second outer edge of said second collection trough wall is spaced farther apart from said axis of rotation than said outer edge said first collection trough wall.

8. A spool housing for a window covering as recited in claim 7, wherein said second collection trough wall extends lengthwise along a second trough axis which is parallel to a second axis defined by said second opening.

9. A spool housing for a window covering as recited in claim 7, wherein at least one of said first collection trough wall or said second collection trough wall has a partial cylindrical shape.

10. A spool housing for a window covering as recited in claim 7, wherein said second opening is defined directly between said first collection trough wall and said second collection trough wall.

11. A spool housing for a window covering as recited in claim 7, wherein at least one of said first collection trough wall or said second collection trough wall is substantially U-shaped.

12. A spool housing for a window covering, comprising a housing wall defining an interior and an exterior;

an inlet nozzle extending outwardly from said housing wall along its exterior, said inlet nozzle including a nozzle wall at least partially defining an opening for receiving a cord, at least a portion of said nozzle wall extending from a proximal end closest to said housing wall and terminating at a distal end further away from said housing wall; and a spool housed in the interior of said housing wall for winding up the cord and having an axis of rotation; wherein:

said inlet nozzle includes a collection trough wall defining a portion of said opening;

said collection trough wall extends away from said distal end of said nozzle wall; and said nozzle wall is tapered outwardly in a direction away from said axis of rotation such that a diameter of said opening at said distal end of said nozzle wall is larger than a diameter of said opening at said proximal end of said nozzle wall.

13. A spool housing for a window covering as recited in claim 12, wherein at least a portion of said opening is defined directIv between said nozzle wall and said collection tough wall.

14. A spool housing for a window covering as recited in claim 12, wherein al least one edge of said colleclioii trough wall is rodiused inwardly.

15. A spool housing for a window covering as recited in claim 12, wherein:

said opening is a first opening and said cord is a first cord;

said inlet nozzle defines a second opening for receiving a second cord; and said second opening is positioned adjacent to said first opening.

16. A spool housing for a window covering as recited in claim 15, wherein said first opening defines a first axis extending perpendicular to said axis of rotation and said second opening defines a second axis extending parallel to said first axis of said first opening.

17. A spool housing for a window covering as recited in claim 16, wherein said collection trough wall extends lengthwise along a trough axis which is parallel to said first and second axes.

18. A spool housing for a window covering as recited in claim 15, wherein said collection trough wall forms a common wall between said first opening and said second opening.

19. A spool housing for a window covering as recited in claim 15, wherein:

said collection trough wall is a first collection trough wall; and said inlet nozzle includes a second collection trough wall that extends away from an outer edge said first collection trough wall such that a second outer edge of said second collection trough wall is spaced farther apart from said axis of rotation than said outer edge of said first collection trough wall.

20. A spool housing for a window covering as recited in claim 19, wherein said second collection trough wall-extends lengthwise along a second trough axis which is parallel to a second axis defined by said second opening.

21. A spool housing for a window covering as recited in claim 19, wherein at least one of said first collection trough wall or said second collection trough wall has a partial cylindrical shape.

22. A spool housing for a window covering as recited in claim 19, wherein at least one of said first collection trough wall or said second collection trough wall is substantially U-shaped.

* * * * *